US010520892B2

(12) United States Patent
Robin

(10) Patent No.: US 10,520,892 B2
(45) Date of Patent: Dec. 31, 2019

(54) LUNAR PHASE DISPLAY DEVICE

(71) Applicant: Blancpain SA, Le Brassus (CH)

(72) Inventor: Martin Robin, Geneva (CH)

(73) Assignee: Blancpain SA, Le Brassus (CH)

( * ) Notice: Subject to any disclaimer, the term of this patent is extended or adjusted under 35 U.S.C. 154(b) by 141 days.

(21) Appl. No.: 15/888,204

(22) Filed: Feb. 5, 2018

(65) Prior Publication Data

US 2018/0267473 A1 Sep. 20, 2018

(30) Foreign Application Priority Data

Mar. 20, 2017 (EP) ..... 17161916

(51) Int. Cl.
*G04B 19/26* (2006.01)
*G04B 19/04* (2006.01)

(52) U.S. Cl.
CPC ..... *G04B 19/268* (2013.01); *G04B 19/046* (2013.01)

(58) Field of Classification Search
CPC ..... G04B 19/048; G04B 19/268
See application file for complete search history.

(56) References Cited

U.S. PATENT DOCUMENTS 309,257 A 12/1884 Seem
4,853,908 A * 8/1989 Bourquin ..... G04B 19/266 368/19
4,881,213 A * 11/1989 Zaslawsky ..... G04B 19/268 368/15
5,280,461 A * 1/1994 Belik ..... G04B 19/048 368/223
5,345,429 A * 9/1994 Rebeaud ..... G04B 19/26 368/15
6,507,536 B1 * 1/2003 Keatch ..... G04B 19/268 368/16
6,885,614 B2 * 4/2005 Rey-Mermet ..... G04B 19/268 368/16
2015/0063077 A1 * 3/2015 Karsch ..... G04B 19/268 368/16

FOREIGN PATENT DOCUMENTS

CH 706 094 A1 8/2013

OTHER PUBLICATIONS

European Search Report dated Sep. 25, 2017 in European Application 17161916.6 filed on Mar. 20, 2017 (with English Translation of Categories of Cited Documents).

* cited by examiner

*Primary Examiner* — Daniel P Wicklund
(74) *Attorney, Agent, or Firm* — Oblon, McClelland, Maier & Neustadt, L.L.P.

(57) ABSTRACT

A lunar phase display device including an annular cover including four ring portions, two successive ring portions being separated by a convex lobe projecting radially towards the inside of the annular cover; a moon indicator disc, a drive device arranged to move the moon indicator disc so that the disc makes a cycloidal trajectory between two successive lobes, the moon indicator disc being at least partially occulted by each of the two lobes during one portion of the cycloidal trajectory so as to reproduce the phases of the moon during a lunar month.

11 Claims, 2 Drawing Sheets

LUNAR PHASE DISPLAY DEVICE

This application claims priority from European Patent Application No. 17161916.6 filed on Mar. 20, 2017, the entire disclosure of which is hereby incorporated herein by reference.

FIELD OF THE INVENTION

The invention relates to a device for the display of the current lunar phase visible at a determined point on the earth's surface.

BACKGROUND OF THE INVENTION

In the prior art there are numerous lunar phase display devices, especially incorporated in watches.

By way of example, EP Patent No 2392976 discloses a device comprising a moon disc and a dial comprising an aperture of substantially semi-circular shape. The moon disc is driven in rotation to display the indications marked on the moon disc through the aperture to indicate the phases of the moon. This mechanism includes a first occultation disc rotatably housed between the moon disc and the dial, and a drive train driving the first occultation disc such that the indications marked on the moon disc are at least partially obscured during certain operating phases of the mechanism so that the indications that appear through the aperture correspond to the natural appearance of the moon throughout the duration of the lunation.

CH Patent No 706094 discloses a moon phase display device comprising a dial with an axis, a moon indicator, a cover positioned to conceal the moon indicator in varying degrees, and first rotational drive means for the moon indicator to move the moon indicator in rotation.

These devices can satisfactorily reproduce the appearance of the moon. However, they are complicated and of great thickness.

SUMMARY OF THE INVENTION

It is an object of the invention to overcome the drawbacks of the state of the art by proposing a moon phase display device that is simpler and of lesser thickness than those of the prior art.

To achieve this, there is proposed, according to a first aspect of the invention, a moon phase display device including:

- an annular cover comprising four ring portions, two successive ring portions being separated by a convex lobe projecting radially towards the inside of the annular cover;
- a moon indicator disc,
- drive means arranged to move the moon indicator disc so that it makes a cycloidal trajectory between two successive lobes, the moon indicator disc being at least partially occulted by each of the two lobes during one portion of the cycloidal trajectory so as to reproduce the phases of the moon during a lunar month.

The moon indicator disc will thus make four cycloidal trajectories when it completes one revolution of the display device. During each cycloidal trajectory, the moon indicator disc starts from a position in which it is entirely concealed by a lobe. This position represents the new moon. The moon indicator disc will then gradually be revealed until halfway through the cycloidal trajectory. When it is halfway through the cycloidal trajectory, it is no longer concealed by a lobe, so that it represents the full moon. The disc will then continue on the cycloidal trajectory, and be increasingly obscured by the following lobe until it is totally obscured again.

The display device according to the first aspect of the invention may also exhibit one or more of the following features, taken individually or in all technically possible combinations.

Advantageously, the annular cover comprises a centre, the drive means comprising an arm having:

- a first end arranged to be rotatably movable about a first axis of rotation passing through the centre of the annular cover;
- a second end, the moon indicator disc being arranged to make a rotational motion about a second axis of rotation passing through the second end of the arm.

The cycloidal trajectory of the moon indicator disc is thus obtained via a double movement of rotation: the arm makes a first movement of rotation about the first axis of rotation, while the moon indicator disc makes a second movement of rotation about the second axis of rotation passing through one end of the arm.

Advantageously, the drive means further include:

- an annular crown provided with an inner toothing;
- a pinion provided with an outer toothing that meshes with the inner toothing of the annular crown, the second end of the arm being connected to the pinion such that the pinion is rotatably movable about the second axis of rotation, the moon indicator disc being fixed at an off-centre point of the pinion.

Advantageously, each lobe has a round shape of the same diameter as that of the moon indicator disc, so that said lobe completely conceals the moon indicator disc when the latter is behind said lobe, but so that, at the same time, the disc starts to be revealed immediately when its centre is offset with respect to the centre of the lobe.

Advantageously, the cover and the moon indicator disc are sized such that there is a position between two successive lobes in which the moon indicator disc is simultaneously tangent to the two successive lobes. This position corresponds to the full moon.

Advantageously, each ring portion has the shape of an arc of a circle.

Advantageously, the display device further includes transmission means arranged to drive the arm in rotation about the first axis of rotation.

Advantageously, the transmission means are configured such that the arm makes one complete revolution about the first axis of rotation in four lunar months.

A second aspect of the invention concerns a timepiece including a display device according to the first aspect of the invention.

Advantageously, the annular cover is a dial of the timepiece.

Advantageously, the transmission means are connected to the timepiece movement of the timepiece.

Advantageously, the timepiece includes hands, the dial being arranged between the hands and the moon indicator disc.

BRIEF DESCRIPTION OF THE DRAWINGS

Other features and advantages will appear clearly from the following description, given by way of non-limiting illustration, with reference to the annexed drawings, in which.

DETAILED DESCRIPTION OF ONE EMBODIMENT

Figure 1:
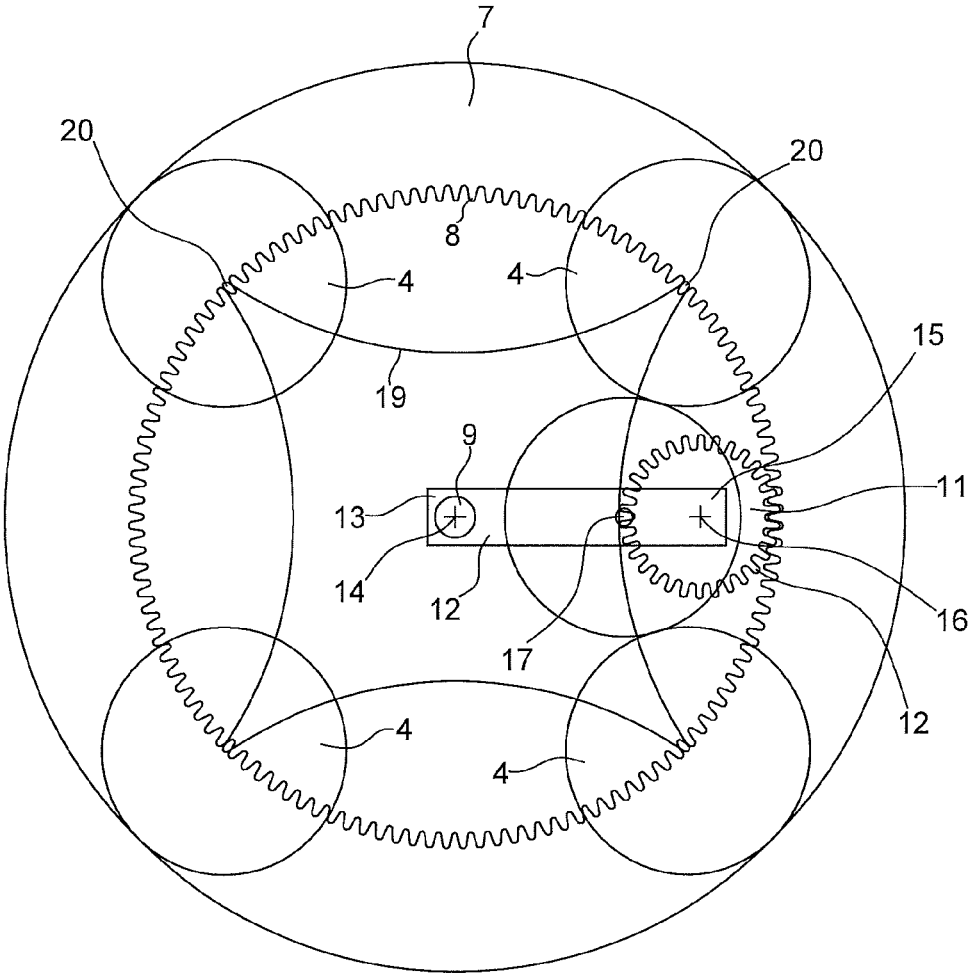
FIG. 1 represents a schematic view of a display device according to one embodiment of the invention.

A display device 1 and a watch including such a display device will now be described with reference to FIGS. 1 and 2.

Display device 1 includes a cover 2. This cover 2 is annular. Annular cover 2 has a symmetry of revolution with respect to its centre 9. Cover 2 includes four ring portions 3. Two successive ring portions 3 are separated by a convex lobe 4 protruding radially towards the inside of cover 2. Lobes 4 are preferably evenly distributed over the periphery of cover 2, such that ring portions 3 all have the same length.

Figure 2:
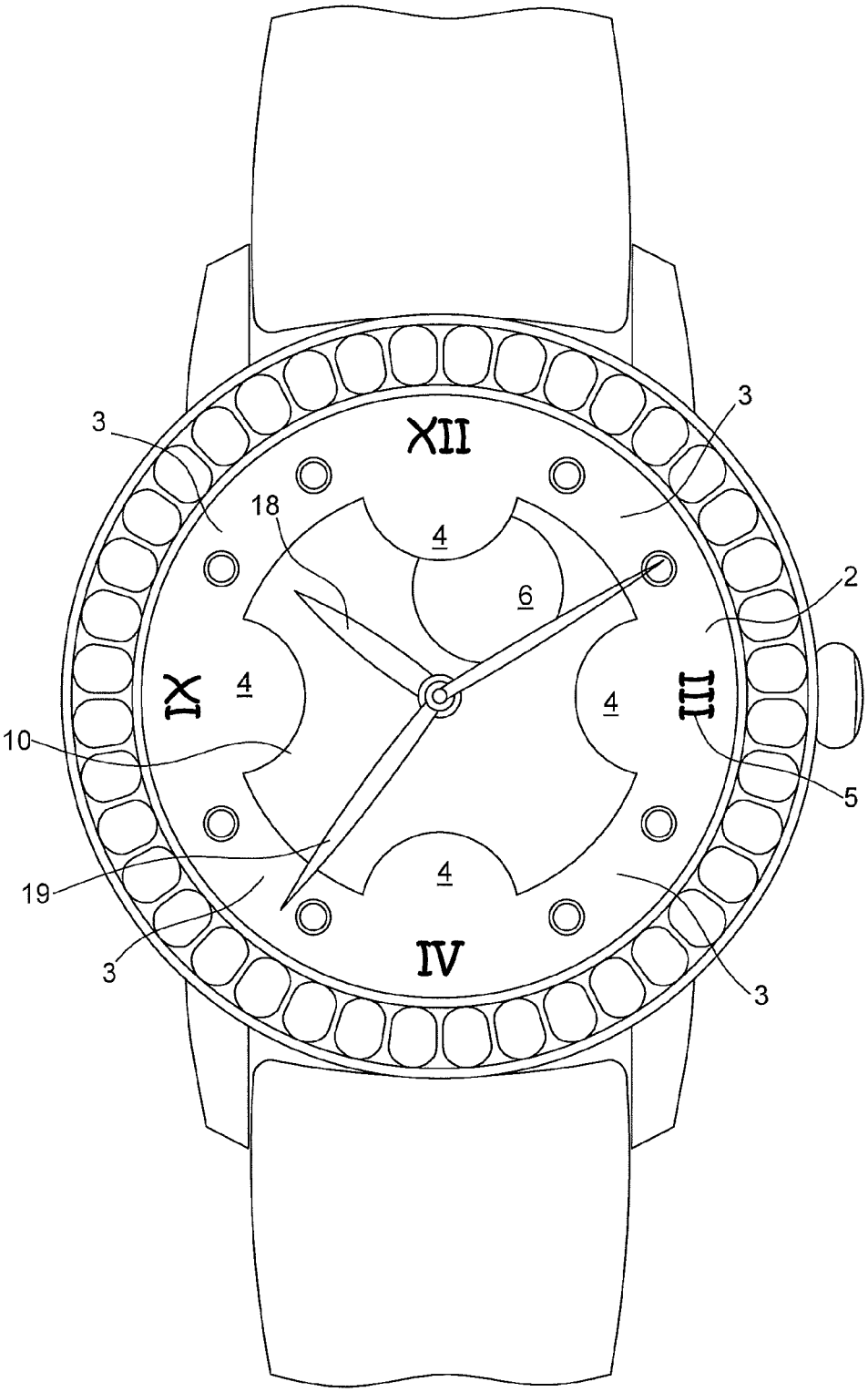
FIG. 2 represents a schematic view of a watch according to one embodiment of the invention.

Cover 2 preferably forms the dial of a watch as represented in FIG. 2. Lobes 4 are preferably arranged at 3 o'clock, 6 o'clock, 9 o'clock and 12 o'clock.

Cover 2 preferably includes symbols 5. Each symbol 5 is preferably aligned with a lobe 4 as represented in FIG. 2.

The display device also includes a disc 6 representing the moon. This disc 6 is also called the "moon indicator disc" in this document. This disc 6 can represent the moon phases during four lunar months by moving behind cover 2. It is preferably provided with a design representing the visible face of the moon.

The display device includes drive means arranged to move disc 6 in a cycloidal motion 19 between the centres 20 of two successive lobes 4.

These drive means preferably include a crown 7 provided with an inner toothing 8. Crown 7 has annular geometry about a central point 10 superposed with the centre 9 of annular cover 2.

The drive means also include a pinion 11 provided with an outer toothing 12 that meshes with inner toothing 8 of crown 7.

The drive means also include an arm 12. Arm 12 includes a first end 13 arranged to be rotatably movable about a first axis of rotation 14 passing through the centre of annular cover 2. Arm 12 also includes a second end 15 fixed to pinion 11 so that it is rotatably movable with respect to a second axis of rotation 16. Second axis of rotation 16 passes through the centre of pinion 11 and traverses the second end 15 of the arm.

Disc 6 representing the moon is fixed such that its centre also rotates about second axis of rotation 16. To that end, disc 6 is preferably fixed on pinion 11. More specifically, centre 17 of disc 6 is preferably fixed at an off-centre point of pinion 11. The centre of disc 6 and the centre of pinion 11 are thus offset with respect to each other.

When arm 12 is driven in rotation about first axis of rotation 14, it drives in rotation pinion 11, which rotates about second axis of rotation 16 while meshing in inner toothing 8 of crown 7. Disc 6 is thus also driven in rotation about second axis of rotation 16. Since second axis of rotation 16 makes a movement of rotation about first axis of rotation 14, the centre of disc 6 makes a cycloidal trajectory 19. Each cycloidal trajectory 19 extends from centre 20 of one lobe 4 to centre 20 of the next lobe 4. When arm 12 make one complete revolution about first axis of rotation 14, disc 6 thus makes four cycloidal trajectories 19, as represented in FIG. 1.

During each cycloidal trajectory 19, disc 6 will concealed to varying degrees by the lobes 4 between which the disc moves.

More specifically, at the start of each cycloidal trajectory 19, disc 6 is completely concealed behind a first lobe 4. This position represents the new moon. The more disc 6 advances on each cycloidal trajectory, the more of the disc will be revealed, until it reaches the middle of cycloidal trajectory 19. In the middle of each cycloidal trajectory, as represented in FIG. 2, disc 6 is completely revealed. In this position, disc 6 is preferably tangent to the two lobes 4 that surround it. This position represents the full moon.

Disc 6 will then gradually be concealed by the next lobe 4, until it again reaches a position in which it is completely concealed by this new lobe.

The speed of rotation of arm 12 about first axis of rotation 14 is chosen such that disc 6 completes each cycloidal trajectory 19 in one lunar month.

As the display disc is preferably incorporated in a timepiece, arm 12 is preferably driven in rotation by the timepiece movement. First axis of rotation 14 is preferably coincident with the axis of rotation of hands 18 of the timepiece.

Naturally, the invention is not limited to the embodiments described with reference to the Figures, and variants could be envisaged without departing from the scope of the invention.

What is claimed is:

1. A lunar phase display device comprising:

an annular cover comprising four ring portions, two successive ring portions being separated by a convex lobe projecting radially towards the inside of the annular cover;

a moon indicator disc, drive means arranged to move the moon indicator disc so that said disc makes a cycloidal trajectory between two successive lobes of the convex lobes, the moon indicator disc being at least partially occulted by each of the two successive lobes during one portion of the cycloidal trajectory so as to reproduce the phases of the moon during a lunar month.

2. The display device according to claim 1, wherein the annular cover comprises a centre, the drive means comprising an arm including:

a first end arranged to be rotatably movable about a first axis of rotation passing through the centre of the annular cover;

and a second end, the moon indicator disc being arranged to make a rotational motion about a second axis of rotation passing through the second end of the arm.

3. The display device according to claim 2, wherein the drive means further comprise:

an annular crown provided with an inner toothing;

a pinion provided with an outer toothing that meshes with the inner toothing of the annular crown, the second end of the arm being connected to the pinion such that the pinion is rotatably movable about the second axis of rotation, the moon indicator disc being fixed at an off-centre point of the pinion.

4. The display device according to claim 2, further including transmission means arranged to drive the arm in rotation about the first axis of rotation.

5. The display device according to claim 4, wherein the transmission means are configured such that the arm makes one complete revolution about the first axis of rotation in four lunar months.

6. The display device according to claim 1, wherein each of the lobes has a round shape of equal diameter to that of the moon indicator disc.

7. The display device according to claim 1, wherein the cover and the moon indicator disc are sized such that there is a position between the two successive lobes in which the moon indicator disc is simultaneously tangent to the two successive lobes.

8. The display device according to claim 1, wherein each of the ring portions has the shape of an arc of a circle.

9. A timepiece including a display device according to claim 1.

10. The timepiece according to claim 9, wherein the annular cover is a dial of the timepiece.

11. The timepiece according to claim 10, comprising hands, the dial being disposed between the hands and the moon indicator disc.

* * * * *